US008319693B2

(12) United States Patent
Chakam et al.

(10) Patent No.: US 8,319,693 B2
(45) Date of Patent: Nov. 27, 2012

(54) ANTENNA MODULE FOR A MOTOR VEHICLE

(75) Inventors: Guy-Aymar Chakam, Neutraubling (DE); Christian Schneider, Lappersdorf (DE)

(73) Assignee: Continental Automotive GmbH, Hannover (DE)

( * ) Notice: Subject to any disclaimer, the term of this patent is extended or adjusted under 35 U.S.C. 154(b) by 87 days.

(21) Appl. No.: 11/754,055

(22) Filed: May 25, 2007

(65) Prior Publication Data

US 2007/0279304 A1 Dec. 6, 2007

(30) Foreign Application Priority Data

May 30, 2006 (DE) ..... 10 2006 025 176

(51) Int. Cl.
*H01Q 1/32* (2006.01)

(52) U.S. Cl. ..... 343/713; 343/711

(58) Field of Classification Search ..... 343/711, 343/715, 676, 829, 846, 850, 860, 909, 767, 343/713, 862, 712, 906, 702
See application file for complete search history.

(56) References Cited

U.S. PATENT DOCUMENTS

| | | | | |
|---|---|---|---|---|
| 4,760,402 | A * | 7/1988 | Mizuno et al. | 343/713 |
| 5,099,252 | A * | 3/1992 | Bryant et al. | 343/713 |
| 5,471,222 | A * | 11/1995 | Du | 343/713 |
| 5,565,877 | A * | 10/1996 | Du et al. | 343/715 |
| 5,619,214 | A * | 4/1997 | Lindenmeier et al. | 343/713 |
| 5,805,113 | A * | 9/1998 | Ogino et al. | 343/713 |
| 6,069,588 | A * | 5/2000 | O'Neill, Jr. | 343/713 |
| 6,269,243 | B1 | 7/2001 | Corbefin et al. | |
| 6,275,194 | B1 * | 8/2001 | Ansorge | 343/713 |
| 6,421,018 | B1 * | 7/2002 | Zeilinger et al. | 343/713 |
| 6,424,306 | B1 * | 7/2002 | Militz et al. | 343/715 |
| 6,538,609 | B2 * | 3/2003 | Nguyen et al. | 343/713 |
| 6,686,882 | B2 * | 2/2004 | Petros et al. | 343/700 MS |
| 6,812,900 | B2 * | 11/2004 | Ghabra et al. | 343/713 |
| 6,853,339 | B2 * | 2/2005 | Sievenpiper et al. | 343/713 |
| 6,861,942 | B1 * | 3/2005 | Knapp et al. | 340/2.8 |
| 6,937,197 | B2 * | 8/2005 | Wiedmann et al. | 343/713 |
| 6,999,032 | B2 * | 2/2006 | Pakray et al. | 343/713 |
| 7,034,758 | B2 | 4/2006 | Haidacher et al. | 343/725 |
| 7,046,119 | B2 * | 5/2006 | Ghabra et al. | 340/5.72 |

(Continued)

FOREIGN PATENT DOCUMENTS

| | | |
|---|---|---|
| DE | 100 45 762 | 9/2000 |

(Continued)

OTHER PUBLICATIONS

German Office Action, German application No. 10 2006 025 176.8-55, 3 pages, Feb. 18, 2010.

*Primary Examiner* — Jacob Y Choi
*Assistant Examiner* — Kyana R McCain
(74) *Attorney, Agent, or Firm* — King & Spalding L.L.P.

(57) ABSTRACT

An antenna module for a motor vehicle has a first antenna device having at least one antenna 5, 7, 9, 11, 13 for the exterior of the motor vehicle, which antenna is arranged in the external area of the motor vehicle, and a second antenna device having at least one antenna 25, 27, 29, 31 for the interior of the motor vehicle, which antenna is arranged in the interior of the motor vehicle, the first antenna device and second antenna device being electrically coupled to each other for the purpose of supplying electricity to the antenna devices.

21 Claims, 3 Drawing Sheets

U.S. PATENT DOCUMENTS

| | | | | |
|---|---|---|---|---|
| 7,083,226 | B2 * | 8/2006 | Schoenauer et al. | 296/214 |
| 7,091,915 | B1 * | 8/2006 | Truthan et al. | 343/715 |
| 7,260,356 | B2 * | 8/2007 | Helstrom et al. | 455/3.02 |
| 7,308,289 | B2 * | 12/2007 | Sychta | 455/569.1 |
| 7,609,216 | B2 * | 10/2009 | Yegin et al. | 343/713 |
| 2003/0107520 | A1 * | 6/2003 | Terk et al. | 343/713 |
| 2006/0262018 | A1 * | 11/2006 | Mikami et al. | 343/713 |

FOREIGN PATENT DOCUMENTS

| | | | |
|---|---|---|---|
| DE | 103 30 087 | | 7/2003 |
| GB | 2 298 998 | A | 9/1996 |
| IE | 0 932 266 | B1 | 7/1999 |
| JP | 62-126 726 | A | 6/1987 |
| JP | 6-140988 | A | 5/1994 |

* cited by examiner

ANTENNA MODULE FOR A MOTOR VEHICLE

CROSS-REFERENCE TO RELATED APPLICATIONS

This application claims priority from German Patent Application No. 10 2006 025 176.8, which was filed on May 30, 2006, and is incorporated herein by reference in its entirety.

TECHNICAL FIELD

The invention relates to an antenna module for a motor vehicle.

BACKGROUND

Antenna modules of this kind are used in automotive engineering to enable radio services such as broadcast reception, GPS information, vehicle access control system, control of the immobilizer system, engine start release, setting of personal preferences, passenger compartment monitoring, parking aid, tire pressure monitoring, etc.

Services of these kinds are sometimes separated into services for the exterior of the motor vehicle and services for the interior of the motor vehicle, said services also being transmitted on different frequencies (LF, HF) or bands. In contrast, some services require a transmission that is effective beyond the limits of the motor vehicle, such as, for example, the communication between ID transmitter (key) and the control device for the access control system, passenger compartment monitoring and engine start or, as the case may be, control of the immobilizer, in order to identify the precise position of a person and initiate corresponding actions as a function of said position.

In order to enable these different services partly on different frequencies for the exterior of the motor vehicle and for the interior of the motor vehicle, a plurality of antennas are typically arranged inside the motor vehicle and outside on the exterior of the motor vehicle.

However, arranging a plurality of antennas possibly including power supply (control devices and/or active antennas) and forwarding of the transmitted signals requires an increased cabling overhead and consequently, given the increased number of services available in today's motor vehicles, is disadvantageously time-consuming and cost-intensive in production as well as in maintenance and any subsequent installation and repair. Added to this is the problem of realizing a precise electromagnetic separation of the antennas or, as the case may be, their transmitting and/or receiving fields in view of the increased number of antennas.

SUMMARY

There exists a need for an antenna module which avoids the aforementioned disadvantages and provides a plurality of services in a cost-effective and simple manner and which at the same time reduces the cabling overhead.

According to an embodiment, an antenna module has a first and a second antenna device which consist of at least one antenna for the exterior of the motor vehicle and at least one antenna for the interior of the motor vehicle respectively. The antenna for the exterior of the motor vehicle is arranged in the external area of the motor vehicle and the antenna for the interior of the motor vehicle is arranged in the interior of the motor vehicle.

According to another embodiment, an antenna module for a motor vehicle may comprise at least a first antenna arranged on the exterior of the motor vehicle, and at least a second antenna arranged within the interior of the motor vehicle adjacent to said first antenna, an electrical coupling between the first antenna and second antenna coupling said first and second antenna with a control device.

BRIEF DESCRIPTION OF THE DRAWINGS

The invention is explained in more detail below with reference to an exemplary embodiment illustrated in the drawing, in which.

DETAILED DESCRIPTION

Figure 1:
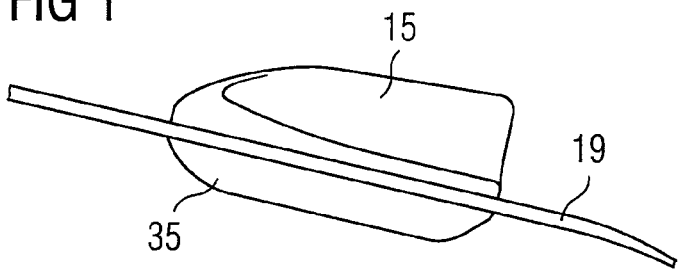
FIG. 1 shows a schematic three-dimensional view of an antenna module with housing according to an embodiment.

By embodying an antenna module which is separated partly on the exterior and partly in the interior, in other words separated at best or, as the case may be, preferably by the vehicle bodywork located in this area (roof area, rear end area), it is advantageously possible to shorten the cable runs to a single electronics assembly that is responsible for the entire antenna module (control device or at least a common part of its electronics, namely transmitter device, receiver device, bus coupling device, evaluation device, pre-evaluation device, transducer device, etc.), since the antenna devices are electrically coupled accordingly for the purpose of insuring their electricity supply and hence that of the antenna or, as the case may be, antennas. This advantageously removes the need for longer cable runs or complex additional control devices that would otherwise be necessary per antenna device or even per antenna. Furthermore, a field shielding or even an optimal (electromagnetic) separation of fields for the exterior and interior of the motor vehicle is effected by the vehicle bodywork (vehicle sheet metal panels), with the result that—aside from an avoidance of sources of unwanted noise (for example interference, crosstalk, etc.)—it is made possible to clearly distinguish whether signals originate from the exterior or interior of the motor vehicle.

For the electrical coupling for the purpose of supplying electricity to the antennas (for example by means of cables, connecting plugs, coaxial plugs, waveguides), an appropriately small cutout through the vehicle bodywork in the area of the module is sufficient, with the result that the remaining area of the vehicle bodywork (for example the metal or panels in the roof, door, rear end or side area) serves to provide an effective desired shielding or, as the case may be, separation, in particular in the HF range (preferably from 13.56 MHz, from 80 MHz, in particular the ISM bands—for example 315, 433, 866 MHZ), as well as for the design and dimensioning of the antenna.

According to an embodiment, each of the antenna devices comprises a carrier plate on which the antenna for the interior of the motor vehicle and the exterior of the motor vehicle is arranged and can be connected accordingly to a control device. Said carrier plate serves on the one hand to accommodate the antennas and cable runs and on the other hand for mounting on the vehicle bodywork, in which case, for example, fixings by means of gluing, screws, etc. are conceivable.

In this embodiment it is possible in addition, apart from a cutout (which can also serve as a mechanical coupling or, as the case may be, securing means) in the carrier plate and the vehicle bodywork (for example vehicle sheet metal panels in the rear end or roof area) for electrically contacting the first antenna device with the second antenna device, to provide at least a further cutout by means of which the two antenna devices or, as the case may be, their carrier plates are in each case connected to the vehicle bodywork and thereby fixed to the motor vehicle.

According to a further embodiment, the first and second carrier plates are arranged on the bodywork of the motor vehicle in such a way that they overlap at least in an area of the vehicle bodywork on the inside and outside of the vehicle bodywork and as a result the cable runs (between first and second antenna device and to the control device) can be kept short.

In this embodiment at least one common cutout for electrical (through-)contacting or for electrical contacting and for mechanical fixing can be provided in addition in the overlapping area. By this means both the electrical contacting and the mechanical contacting can be effected by way of a connection of the two antenna devices or, as the case may be, their carrier plates to one another through the vehicle bodywork (for example by means of locking elements, screws, etc.), the electrical contacting also being able to serve simultaneously as a mechanical fixing (e.g. by means of a hollow or tubular oblong retaining element having a cavity for running cables and external thread or locking elements for mechanical fixing). In this embodiment the common cutout therefore serves simultaneously for the electrical and/or mechanical contacting of the two carrier plates.

According to another embodiment, the first and/or second antenna device have/has a plurality of antennas for the interior/exterior of the motor vehicle which are provided for different services, such as, for example, SDARS reception, mobile radio, GPS reception, signal transmission for keyless remote control or remote keyless entry (RKE) externally and internally, tire monitoring, in particular tire pressure monitoring (Tireguard), WLAN connection, etc. An antenna module of said kind can therefore be used for receiving and/or transmitting different services (multifunctional) on the same or different frequencies or bands (multiband-capable) with or without known diversity methods (location, polarization, phase diversity or, as the case may be, evaluation of received signals that differ in different parameters due to a reception of a transmitted signal by means of a plurality of antennas).

According to a further embodiment, the common control device or at least a common part of its electronics (transmitter/receiver device, pre-evaluation device, evaluation device, bus coupling device, transducer device, etc.) is integrated in the first or in the second antenna device, with the result that the cable runs can be further shortened and a simpler and more cost-effective assembly is made possible.

The antenna module shown in FIG. 1 has a cover 35 on its underside toward the interior of the motor vehicle and a cover 15 to the external area of the motor vehicle, which covers serve mainly as protective housings for the first and second antenna device located thereunder. As shown in FIG. 1, the cover 15 is situated externally on the vehicle bodywork 19, for example on the roof in the center rear area of the vehicle, and the cover 35 is located in the interior of the vehicle on the vehicle bodywork 19, i.e. for example in the vehicle roof lining in the central area of the rear passenger compartment of the vehicle.

Figure 2:
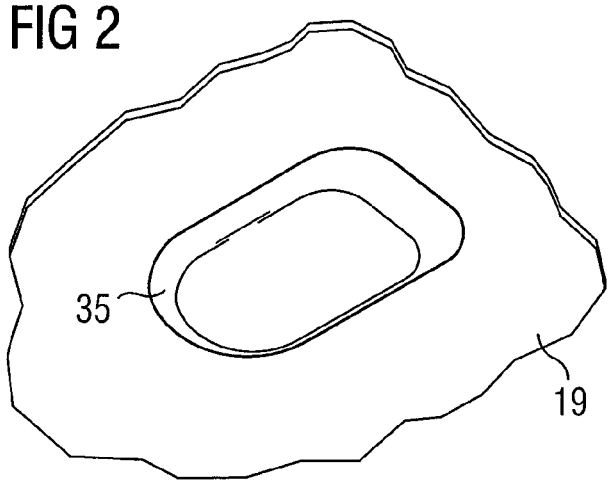
FIG. 2 shows a schematic three-dimensional bottom view of an antenna module according to FIG. 1.

FIG. 2 shows the shape of the internal housing cover 35 on which, for example, interior lighting (not shown in further detail) for the rear passenger compartment of the vehicle can be arranged in addition.

Figure 3:
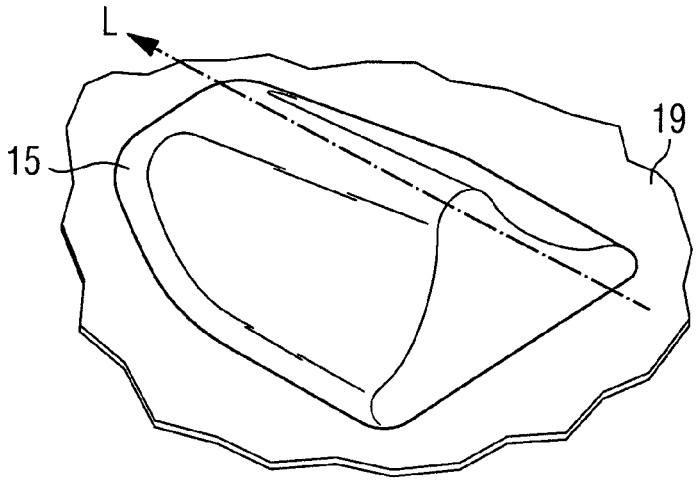
FIG. 3 shows a schematic three-dimensional top view of an antenna module according to FIG. 1.

FIG. 3 shows an exemplary shape of the external housing cover 15, referred to as a fin, which, in order to offer a minimum of aerodynamic resistance, is advantageously arranged in the longitudinal direction L with the tip of the arrow pointing in the direction of travel.

Figure 4:
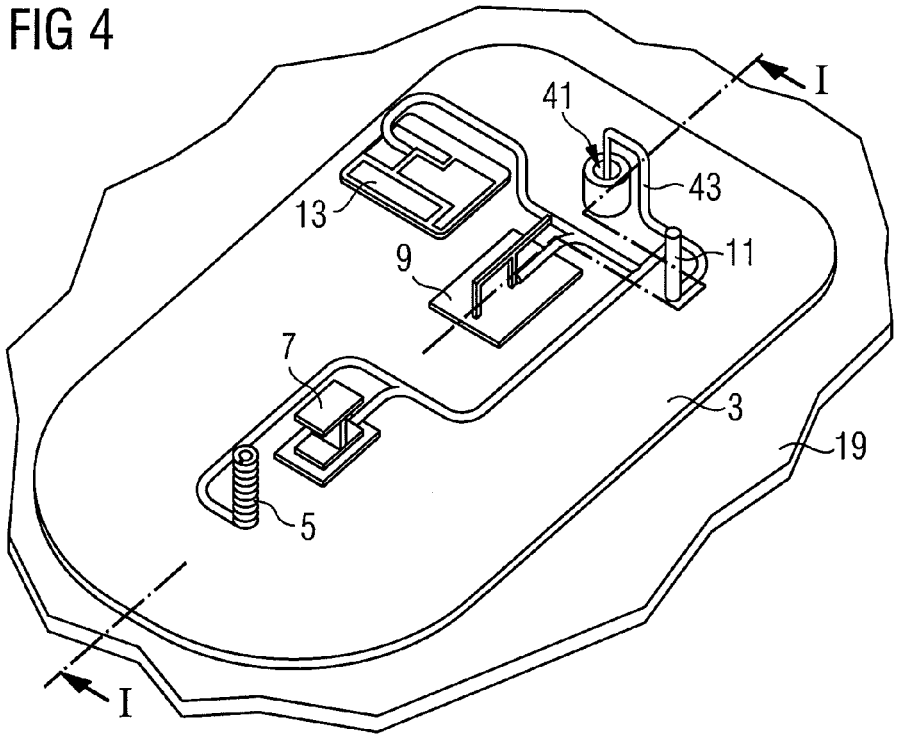
FIG. 4 shows a schematic partial view of a carrier plate of an antenna module according to FIG. 1.

FIG. 4 shows a detail view of a carrier plate as arranged under the covers 15 and 35 on the bodywork 19 on the exterior and interior. A carrier plate of this type has, for example as the first carrier plate, a first antenna device for the external area. Said first antenna device consists—as shown—for example of a mobile radio antenna 5 (e.g. GSM), a GPS antenna 7 (in the GHz range), a WLAN antenna 9 (e.g. 2.45 GHz or 5.8 GHz), an RKE antenna 11 (e.g. 315 MHz, 433 MHz or 868 MHz) for the external area, and an SDARS (digital satellite radio or, specifically, Satellite Digital Audio Radio Service) antenna 13 which—as shown schematically—are connected via a cable 43 or, as the case may be, a cable harness to a control device (not shown in further detail) or, as the case may be, a transmitter and/or receiver device.

Figure 5:
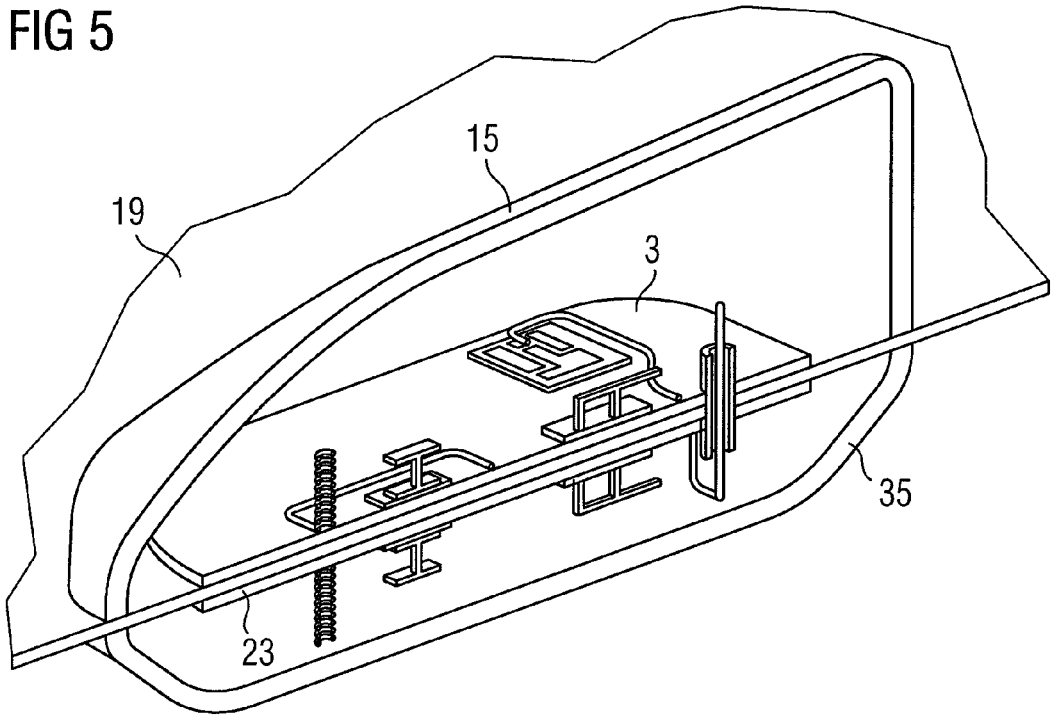
FIG. 5 shows a schematic three-dimensional sectional view along the line I-I in FIG. 4 with housing shown in addition.

As shown in FIG. 5, there are located in the same area of the vehicle bodywork 19 on the outside and on the inside in an at least overlapping manner a first carrier plate 3 and a second carrier plate 23 which are preferably of identical design to reduce manufacturing costs and—as shown—can be arranged congruently on the top side and underside of the vehicle bodywork.

Figure 6:
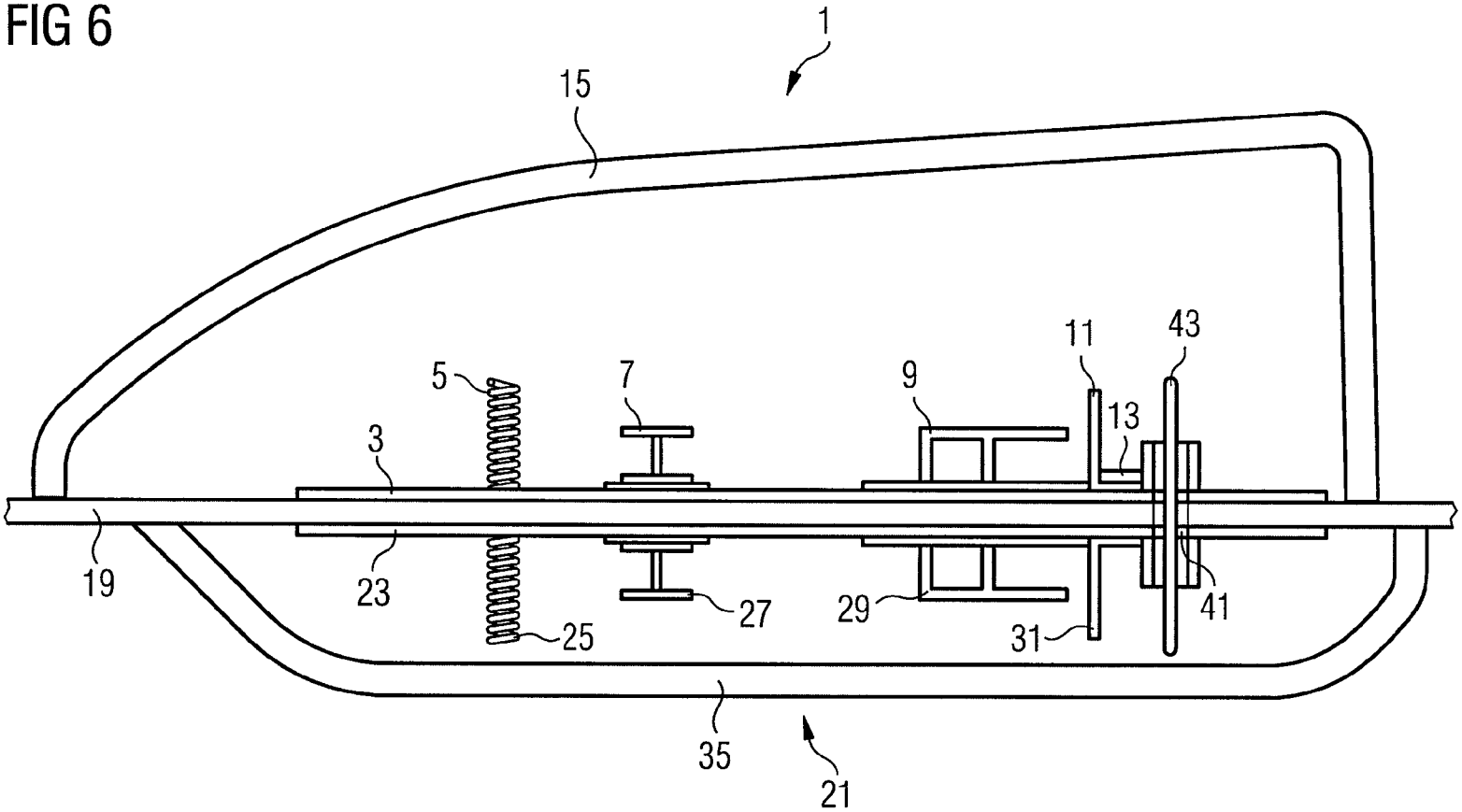
FIG. 6 shows an enlarged side view according to FIG. 5.

As can be seen from the enlarged illustration in FIG. 6, the housing edges of the covers 15 and 35 do not necessarily have to be aligned with each other, so that even if the first and second carrier plate 3, 23 overlap completely, a certain offset, as shown in FIG. 6, of the edges of the housing covers 15 and 35 with respect to each other is possible.

As can be seen from FIG. 6, the second antenna device has a second carrier plate 23 identical in construction to the first antenna device or, as the case may be, first carrier plate 3, with in this case the illustrated antenna services toward the interior of the vehicle, such as, for example, Tireguard antenna 25, RKE antenna 31 for the internal area, Bluetooth antenna 27 for the internal area, and WLAN antenna 29 for the internal area, being provided.

It is of course also conceivable, however, to equip the first and second antenna device or, as the case may be, their carrier plates 3 and 5 with different antennas for the most diverse bands and services, from simple dipole antennas through patch antennas, HF antennas to complex multiband antenna structures.

The antennas 25, 27, 29 and 31 on the second carrier plate 23 are, of course, likewise connected via the cable 43 or, as the case may be, cable harness to a single control device (not shown in further detail) that is simultaneously responsible for both the first and the second device.

Said control device can be located either outside the antenna module or else inside the antenna module, integrated on the first or second carrier plate 3, 23 for example. In order to ensure the electrical contacting or, as the case may be, coupling for supplying electricity to the antenna device by means of the cable harness 43, a small cutout 41 through which the cable harness 43 is routed is located in the vehicle bodywork 19, for example the vehicle roof.

In order to enable at the same time a mechanical coupling or, as the case may be, fixing of the carrier plate 3 to the carrier plate 23 and hence to the internal and external area of the vehicle bodywork instead of the electrical coupling by means of cutout 41 and cable harness 43, it is possible for example—as indicated in FIG. 6—by means of a corresponding aligned cutout in the vehicle bodywork and the first and second carrier plate 3, 23 to insert a tubular sleeve in the interior of which the cable harness 43 runs and on the outside of which an external thread, for example, is tapped so that a mechanical fixing can be effected by, for example, screwing on (cap) nuts (or by a correspondingly embodied internal thread in the cutouts of the carrier plates 3, 23). It is also conceivable to embody waveguide connections such as coaxial or hollow conductor connections or, as the case may be, couplings by means of cap nuts simultaneously as a mechanical connection.

It is additionally conceivable to provide a similar aligned cutout in the vehicle bodywork 19 and first and second carrier plate 3, 23 in another area, through which cutout the first and second carrier plate 3, 23 can be mechanically fixed to the vehicle bodywork in this area for example by means of screw and nut, locking element, etc. without a further electrical (through)contacting being necessary in addition in this case.

It is of course also possible, however, to effect the mechanical fixing in some other without a further cutout, for example by means of catches arranged on the vehicle bodywork, projections, corresponding bodywork shape, etc. or by means of gluing. In the same way the covers 15 and 35 of the antenna module, according to an embodiment, can be fixed to the outside and inside of the vehicle bodywork 19 in order to avoid damage due to mechanical action, etc.

By means of the module according to an embodiment, services which are to be possible both in the internal area and in the external area, such as, for example, access control system (RKE) in the internal and external area or also different functionalities or, as the case may be, services which take place only in the internal area or only in the external area, can be made realizable in a structurally simple manner. By means of the electrical and possibly additional mechanical coupling of the first to the second antenna device it is moreover ensured that a plurality of services in the external and internal area of the motor vehicle can be optimally provided in a simple manner, in particular by means of diversity methods, without a plurality of control devices and antennas positioned at different points on the motor vehicle being necessary herefor, which control devices and antennas by their nature entail an increased cabling overhead.

LIST OF REFERENCE NUMERALS

3 First carrier plate
5 Telephone antenna (mobile radio)
7 GPS antenna
9 WLAN antenna
11 RKE antenna
13 SDARS antenna
15 Housing or cover, external area
19 Vehicle bodywork (sheet metal panel)
23 Second carrier plate
25 Tireguard antenna
27 Bluetooth antenna
29 WLAN antenna
31 RKE antenna
35 Housing or cover, internal area
41 Cutout
43 Cable (harness)

What is claimed is:

1. An antenna module for a motor vehicle, comprising:

a first antenna device having a plurality of antennas for the exterior of the motor vehicle, which antennas are arranged on the external area of the motor vehicle for wirelessly receiving first communication signals, and a second antenna device having a plurality of antennas for the interior of the motor vehicle, which antennas are arranged in the internal area of the motor vehicle for wirelessly receiving second communication signals, wherein the first antenna device comprises a first carrier plate and the second antenna device comprises a second carrier plate on which the antennas for the interior of the motor vehicle and exterior of the motor vehicle are arranged, wherein the first and second carrier plate are arranged on the bodywork of the motor vehicle in such a way that they overlap at least in an area of the vehicle bodywork on the inside and outside of the vehicle bodywork, wherein at least one common cutout in the bodywork for electrical contacting is provided in the overlapping area;

a control device arranged externally or internally of said antenna module;

wherein the first antenna device and second antenna device are electrically connected to said control device such that electricity from the control device is supplied to both the first and second antenna devices.

2. The antenna module according to claim 1, wherein the control device is a single common control device which includes at least one of the devices selected from the group consisting of transmitter device, receiver device, bus coupling device, evaluation device, pre-evaluation device, and transducer device.

3. The antenna module according to claim 1, wherein the first antenna device receives signals from a plurality of external telecommunication services.

4. The antenna module according to claim 3, wherein the second antenna device receives signals from internal telecommunication services, wherein the plurality of external telecommunication services are different from the plurality of internal telecommunication services.

5. The antenna module according to claim 1, wherein the at least one common cutout further serves for mechanical fixing of the antenna module.

6. The antenna module according to claim 4, wherein the bodywork is the roof of a vehicle.

7. The antenna module according to claim 3, wherein the first carrier plate and the second carrier plate comprise an identical design.

8. The antenna module according to claim 1, wherein the first antenna device has a plurality of antennas for the exterior of the motor vehicle which are provided for different services.

9. The antenna module according to claim 1, wherein the second antenna device has a plurality of antennas for the interior of the motor vehicle which are provided for different services.

10. The antenna module according to claim 1, wherein the common control device is integrated in the first or in the second antenna device.

11. The antenna module according to claim 1, further comprising a first and second housing covering the first and second antenna devices, respectively.

12. The antenna module according to claim 11, wherein the first housing has an aerodynamic shape.

13. An antenna module for a motor vehicle, comprising:

a plurality of first antennas arranged on a first carrier plate mounted within a first housing on an exterior side of a roof of the motor vehicle for wirelessly receiving first communication signals from one or more signal sources located external to the motor vehicle, and a plurality of second antennas arranged on a second carrier plate mounted within a second housing opposite said first carrier plate on an interior side of the roof of the motor vehicle for internal wireless communications of second communication signals with one or more devices located in the interior of the motor vehicle, wherein the first and second carrier plate are arranged in such a way that they overlap, wherein at least one common cutout, through which at least one cable is fed for electrical contacting, is provided in an overlapping area of the roof, an electrical coupling arranged in said common cutout and said first and second carrier plates for electrically connecting said first or second antennas with a control device being arranged outside or inside said motor vehicle.

14. The antenna module according to claim 13, wherein the control device includes at least one of the devices selected from the group consisting of transmitter device, receiver device, bus coupling device, evaluation device, pre-evaluation device, and transducer device.

15. The antenna module according to claim 13, wherein the first carrier plate and the second carrier plate comprise an identical design.

16. The antenna module according to claim 13, wherein the at least one common cutout further serves for mechanical fixing of the antenna module.

17. The antenna module according to claim 13, wherein the first housing has an aerodynamic shape.

18. The antenna module according to claim 13, comprising a plurality of antennas for the exterior of the motor vehicle which are provided for different services.

19. The antenna module according to claim 13, comprising a plurality of antennas for the interior of the motor vehicle which are provided for different services.

20. The antenna module according to claim 13, wherein the common control device is integrated with the first or the second antenna.

21. The antenna module according to claim 13, wherein a bodywork of said vehicle electromagnetically shields said first antennas for the exterior of the motor vehicle from said second antennas for the interior of the motor vehicle.

* * * * *